US009599126B1

(12) United States Patent
Sagher et al.

(10) Patent No.: US 9,599,126 B1
(45) Date of Patent: Mar. 21, 2017

(54) NOISE ABATING IMPELLER

(71) Applicant: AIRTECH VACUUM INC., Englewood, NJ (US)

(72) Inventors: Raphael Sagher, Alpine, NJ (US); Thomas Stergioulas, Ridgefield Park, NJ (US)

(73) Assignee: AIRTECH VACUUM INC., Rutherford, NJ (US)

( * ) Notice: Subject to any disclaimer, the term of this patent is extended or adjusted under 35 U.S.C. 154(b) by 716 days.

(21) Appl. No.: 14/036,789

(22) Filed: Sep. 25, 2013

Related U.S. Application Data

(60) Provisional application No. 61/705,810, filed on Sep. 26, 2012.

(51) Int. Cl.
*F01D 5/12* (2006.01)
*F04D 29/66* (2006.01)

(52) U.S. Cl.
CPC ..... *F04D 29/666* (2013.01)

(58) Field of Classification Search
CPC ..... F04D 29/666; F04D 29/663; F04D 29/66; F04D 29/188; F04D 5/003
USPC ..... 416/203; 415/55.1, 55.5
See application file for complete search history.

(56) References Cited

U.S. PATENT DOCUMENTS 3,259,072 A 7/1966 Carpenter
3,418,991 A 12/1968 Shultz et al.
4,538,963 A * 9/1985 Sugio ..... F04D 29/283 415/119
5,209,630 A 5/1993 Roth
5,266,007 A * 11/1993 Bushnell ..... F04D 29/666 415/119
6,296,439 B1 10/2001 Yu et al.
6,299,406 B1 10/2001 Yu et al.
6,322,319 B1 11/2001 Yoshioka
6,425,733 B1 * 7/2002 Ross ..... F02M 37/048 415/55.1
6,511,283 B1 * 1/2003 Yoshioka ..... F02M 37/048 415/55.1
6,824,361 B2 11/2004 Yu et al.
7,029,227 B2 * 4/2006 Berthillier ..... F01D 5/10 415/1
7,789,627 B2 * 9/2010 Chiang ..... F04D 29/284 416/144
7,997,871 B2 8/2011 Hwang et al.
8,398,380 B2 * 3/2013 Duke ..... F04D 29/281 361/695

* cited by examiner

*Primary Examiner* — Gregory Anderson
*Assistant Examiner* — Jason Fountain
(74) *Attorney, Agent, or Firm* — Galgano IP Law PLLC; Thomas M. Galgano; Jessica G. McDonald

(57) ABSTRACT

A noise abating impeller having a disc-shaped central hub and a plurality of blades extending radially outward from the central hub. The blades are symmetrically arranged in quadrants around the central hub and within two alternating quadrants, each blade is spaced an increasing distance apart from a prior adjacent blade and within the other two alternating quadrants, each blade is spaced a decreasing distance apart from a prior adjacent blade. The impeller also has a dividing rib located along the entire outer peripheral edge of the central hub and located along the center of the blades dividing each blade into a first blade half and a second blade half. The first blade half is offset from the second blade half.

10 Claims, 5 Drawing Sheets

NOISE ABATING IMPELLER

CROSS-REFERENCE TO RELATED APPLICATION

This application claims benefit from U.S. Provisional Patent Application Ser. No. 61/705,810, filed Sep. 26, 2012, the contents of which are hereby incorporated by reference.

BACKGROUND OF THE INVENTION

1. Field of the Invention

The present invention is in the field of impellers. More particularly, the present invention is an impeller which reduces the audible high pitched noise generated in regenerative technology blowers.

2. Brief Description of the Prior Art

Regenerative blowers are non-positive displacement, high volume, low pressure devices that can operate as pneumatic compressors or vacuum pumps. A regenerative blower includes an impeller mounted directly on a motor shaft which is rotated at high speeds. The impeller typically has a large number of airfoil-shaped radial blades on its periphery. As the impeller spins, the blades pass an inlet port which creates a low pressure area and draws air (or other gasses) into the blower housing. A hollow, circular ring between the impeller blade tips and the housing wall acts as a compression space. The rotating impeller blades then use centrifugal force to impart motion to the air in order to accelerate the air radially outward and forward through the housing chamber as it follows the contours.

The "regenerative" principle takes effect as a certain amount of air slips past the tip of each impeller blade and returns to the base of a succeeding blade for re-acceleration within the compression space. Regenerations of the air within the blower housing are repeated and each regeneration becomes another "stage." Each "stage" imparts more pressure to the air and creates a vortex. The pressure increase at each stage may be small, but the large number of stages allows for the incredible continuous operating pressures of the regenerative blowers.

When the vortex of air reaches a separator section at the outlet, i.e., the part of the blower located between the inlet and the outlet in which the annulus is reduced in size to fit closely to the sides and tips of the impeller blades, the air is stripped from the impeller and discharged from the blower. The discharged air is free of pulsation and the pressure or vacuum generated by the one or two spinning, non-contacting, oil-free impellers in regenerative blowers will be equal to the values obtained by many larger multi-stage or positive displacement blowers.

Regenerative blowers are available in many configurations and designed to meet specific applications and are used in a broad range of applications including, but not limited to, pneumatic conveying, sewage acceleration, vacuum lifting, printing presses, and aquaculture/pond aeration. Regenerative blowers have many benefits including simple operation, high reliability, minimal maintenance, a broad performance range, oil-free operation, and a generally low noise level.

Moreover, regenerative blowers often use one or two double-sided or "paddle wheel" impellers. This impeller design has twin vortices and is characterized by higher noise levels as the vortices are created at the inlet and merged at the discharge. The noise created by "paddle wheel" impellers is generally high pitched, and ways to reduce the pitch of this noise are therefore desirable.

Accordingly, it is desirable to have an impeller design that reduces the amplitude of the overall pitch of the noise emitted therefrom by creating several smaller "peaks" in the sound wave over a set period of time, instead of the standard design that has a single "peak" in the sound wave over that same allotted period of time.

While the prior art discloses many types of impellers, so far as is known, none of these assemblies, resolve these problems in a simple, effective and highly advantageous manner, as in the present invention.

SUMMARY OF THE INVENTION

It is therefore an object of the present invention to provide a novel noise abating impeller.

It is also an object of the present invention to provide a novel noise abating impeller which reduces the amplitude of the overall pitch of noise generated by creating several smaller "peaks" in the sound wave over a set period of time.

Additionally, it is an object of the invention to provide an impeller for breaking the "continuity" of a sound wave, staggering the wave slightly and forcing it to rise and fall in a more erratic manner.

It is a further object of the invention to provide a noise abating impeller which reduces high pitched noise emanating therefrom.

Certain of the foregoing and related objects are readily attained according to the present invention by the provision of a noise abating impeller, comprising a disc-shaped central hub having a circular-shaped inner edge defining an opening therebetween which serves as an axis of rotation of said impeller, said central hub having a circular-shaped outer peripheral edge; a plurality of blades extending radially outward from said outer peripheral edge of said central hub, wherein said blades have an inner edge connected to said outer peripheral edge of said central hub and an outer edge defining an outer edge of said impeller, and wherein said blades are symmetrically arranged in groupings around said central hub, wherein within alternating groupings, each blade progressing along said outer peripheral edge of said central hub is spaced an increasing distance apart from a prior adjacent blade by an incremental angle and wherein within the other alternating groupings, each blade progressing along said outer peripheral edge of said central hub is spaced a decreasing distance apart from a prior adjacent blade by said incremental angle and wherein said blades are arranged in said groupings such that adjacent blades have the same distance apart as the adjacent blades located symmetrically across said central hub; and a dividing rib located along the entire outer peripheral edge of said central hub which extends radially outwardly from said outer peripheral edge of said central hub to said outer edge of said impeller, and wherein said divider is located along the center of said blades dividing each of said blades into a first blade half and a second blade half, and wherein said first blade half is offset from said second blade half.

It is preferable that said impeller and said blades are the same material. More particularly, it is preferred that the impeller and said blades are made of aluminum. It is also desirable that the greatest distance between adjacent blades is about 5°. Advantageously, the smallest distance between adjacent blades is about 4°. Preferably said incremental angle is about 0.05°. It is also preferred that said impeller comprises approximately 70 to 90 blades. Desirably, each of said blades is bent at an angle of approximately 169°.

Most preferably, said blades are symmetrically arranged in quadrants around said central hub, wherein within two alternating quadrants, each blade processing along said outer peripheral edge of said central hub is spaced an increasing distance apart from a prior adjacent blade by said incremental angle and wherein within the other two alternating quadrants, each blade processing along said outer peripheral edge of said central hub is spaced a decreasing distance apart from a prior adjacent blade by said incremental angle. Advantageously, said first blade half is offset from said second blade half by one-third of the distance between an adjacent blade.

BRIEF DESCRIPTION OF THE DRAWINGS

Other objects and features of the present invention will become apparent from the detailed description considered in connection with the accompanying drawings, which disclose several embodiments of the invention. It is to be understood that the drawings are to be used for the purpose of illustration only and not as a definition of the limits of the invention.

DETAILED DESCRIPTION OF THE PREFERRED EMBODIMENTS

Figure 1:
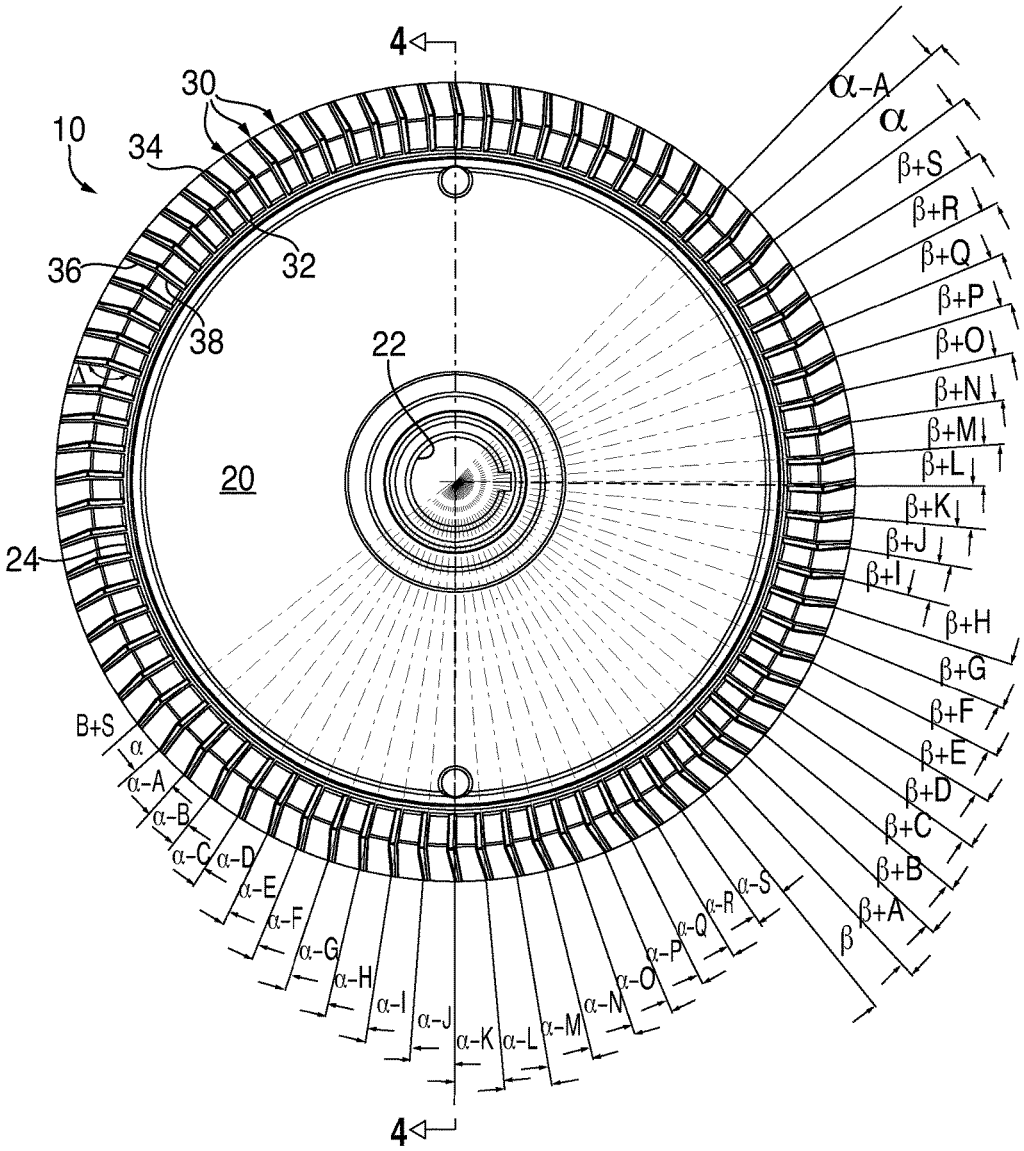
FIG. 1 is a top plan view of the noise abating impeller, according to the present invention, showing the increasing and decreasing spacing between adjacent blades in the four quadrants.

Turning now in detail to the drawings and, in particular, FIG. 1 which illustrates the double-sided or "paddle wheel" noise abating impeller, according to the present invention, generally designated by reference number 10. The impeller 10 is for use in a regenerative blower (not shown) and is configured and dimensioned in order to segment air turbulence inside of a housing chamber (not shown) in the regenerative blower, in order to create several smaller sound peaks that will, as a result, reduce the high pitched noise created by and emitted from the regenerative blower.

Figure 4:
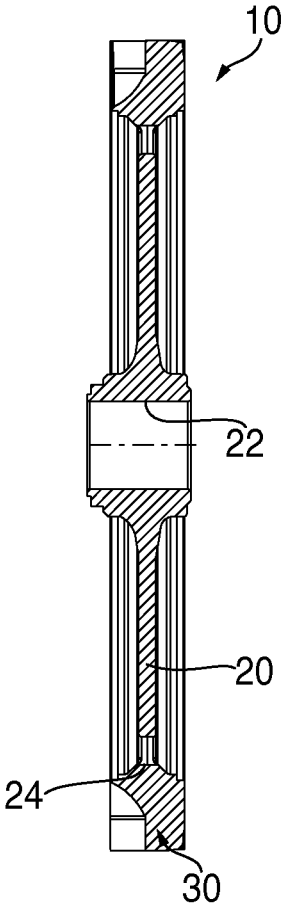
FIG. 4 is a cross-sectional view taken along line 4-4 in FIG. 1.

In particular, as seen in FIGS. 1 and 4, the impeller 10 includes a generally disc-shaped central hub 20 having a circular-shaped inner edge 22 defining a circular shaped central opening. The central opening defined by inner edge 22 serves as an axis of rotation of impeller 10. In use in the regenerative blower, a motor shaft (not shown) is received within the opening in the central hub 20 and drives the impeller 10 to rotate at high speeds within the housing chamber (not shown). Central hub 20 also has a circular-shaped outer peripheral edge 24.

Figure 2:
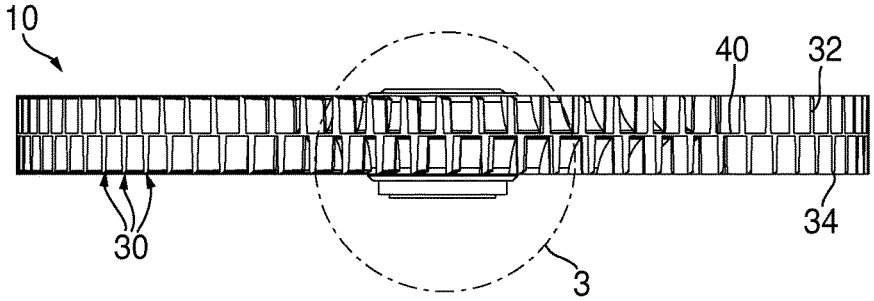
FIG. 2 is a side elevational view of the noise abating impeller.

As also shown in FIGS. 1 and 2, impeller 10 includes a plurality of spaced-apart conventional airfoil-shaped blades 30 which are provided along the entire outer peripheral edge 24 of central hub 20. Particularly, each of the blades 30 extend radially outward from outer peripheral edge 24 of central hub 20. More particularly, as seen best in FIG. 1, blades 30 each have an inner edge 32 connected to outer peripheral edge 24 of central hub 20 and an opposite, outer edge 34 which defines the outer peripheral edge of impeller 10. Preferably, blades 30 and central hub 20 are integrally formed as a one-piece device which is balanced accordingly. Preferably, the central hub 20 and blades 30 are made of aluminum and die cast as a unitary component. However, it can be appreciated that other suitable materials can be utilized. In the preferred embodiment, impeller 10 includes approximately 70 to 90 blades 30. However, depending on the application other suitable number of blades can be utilized.

Furthermore, as seen best in FIG. 1, in the preferred embodiment each blade 30 is bent and has an inner blade portion 38 and outer blade portion 36. As shown in FIG. 1, in the preferred embodiment, outer blade portion 36 in each blade is at an angle $\Delta$ of approximately 169° relative to inner blade portion 38. However, other suitable dimensions of the angle between the inner and outer blade portions can be utilized.

As also seen in FIG. 1, blades 30 extend along and surround the entire periphery of impeller 10 and are symmetrically arranged in sections or groupings, here, in four quadrants around central hub 20. While the blades are illustrated in four symmetrical quadrants, they can be arranged in other numbers of symmetrical groupings, such as, for example, eight groupings or twelve groupings, so long as adjacent blades have the same spacing as the adjacent blades across central hub 20. Particularly, as seen in the preferred embodiment in FIG. 1, blades 30 are arranged in four symmetrical radial quadrants around central hub 20 with progressively increasing spacing between adjacent blades 30 in two alternating quadrants and progressively decreasing spacing between adjacent blades 30 in the other two alternating quadrants. This alternating increasing and decreasing spacing between adjacent blades in alternating sections or groupings serves to break the overall continuity in the sound waves generated and emitted therefrom, and reduce the high pitched noise generated by the regenerative blower.

More particularly, as seen in FIG. 1, within two alternating quadrants each blade 30 progressing along the outer peripheral edge 24 of central hub 20 is spaced an increasing distance apart from the prior adjacent blade 30 by an incremental angle. In the other two alternating quadrants, each blade 30 progressing along the outer peripheral edge 24 of central hub 20 is spaced a decreasing distance apart from the prior adjacent blade 30 by an incremental angle. When other suitable number of sections or groupings are utilized, the spacing between adjacent blades increases in alternating sections and decreases in the other alternating sections. Furthermore, blades 30 are symmetrically arranged around central hub 20 such that adjacent blades 30 have the same spacing apart as the adjacent blades 30 which are located symmetrically across central hub 20.

FIG. 1 details the varying spacing between adjacent blades 30 in two of the four quadrants. The remaining two quadrants have the same symmetrical spacing between blades 30. More particularly, as labeled in FIG. 1, the largest spacing between adjacent blades 30 is represented by the Greek letter Alpha ($\alpha$) and the smallest spacing between adjacent blades is represented by the Greek letter Beta ($\beta$). Each incremental increase or decrease in the spacing between adjacent blades is represented by a letter of the English alphabet. Particularly, one incremental angle change is represented by A, two incremental angle changes (A+A)

are represented by B, three incremental angle changes (A+A+A or by substitution B+A) are represented by C, and so on until the quadrant is completed, such as up until S, as seen in the embodiment shown in FIG. 1. The spacing between adjacent blades 30 increases in alternating quadrants and decreases in the other two alternating quadrants, by the same incremental angle. This variable incremental spacing between adjacent blades provides alternating contracting and expanding spacing between adjacent blades 30 in each of the four quadrants, while progressing along the outer peripheral edge 24 of central hub 20. This serves to reduce the high pitched noise emitted from the impeller.

Furthermore, as seen in FIG. 1, each angle spacing between adjacent blades is represented as a duplication using either the largest angle, a, or the smallest angle 13. In the first quadrant, a is the largest angle and the blades 30 are decreasingly spaced apart by incremental angle A, when progressing along outer peripheral edge 24 of central hub 20. Particularly, the spacing between the adjacent blades is represented by α-A, α-B, α-C and so on until α-S. In the second quadrant, the smallest angle is represented by β and the spacing between adjacent blades increases by incremental angle A. Accordingly, the spacing between adjacent blades increases, β+A, β+B, β+C and so on until β+S. The spacing in the third quadrant decreases to the same extent as the first quadrant and the spacing in the fourth quadrant increases to the same extent as the second quadrant.

Accordingly, the spacing in each quadrant increases or decreases the same incremental angle. An example of this is illustrated by using the smallest angle, β, as an axis. The angles α-Q and β+C are equivalent. Using the same axis, it can also be seen in FIG. 1 that the angles α-N and β+F are equal, as well as the angles α-J and β+J. Furthermore, the spacing between adjacent blades 30 is equal to the spacing on adjacent blades located symmetrically across central hub 20. In the preferred embodiment, the largest spacing a between adjacent blades is about 5° and the smallest spacing between adjacent blades β is about 4° and the incremental angle A is about 0.05°. The remaining spacing between adjacent angles can be calculated using the formulas listed in FIG. 1. It can be appreciated that the spacing between adjacent blades illustrated in FIG. 1 is a preferred embodiment and shown for the purpose of illustration. The blade spacing can be modified as desired to suit the particular application of the impeller.

Figure 5:
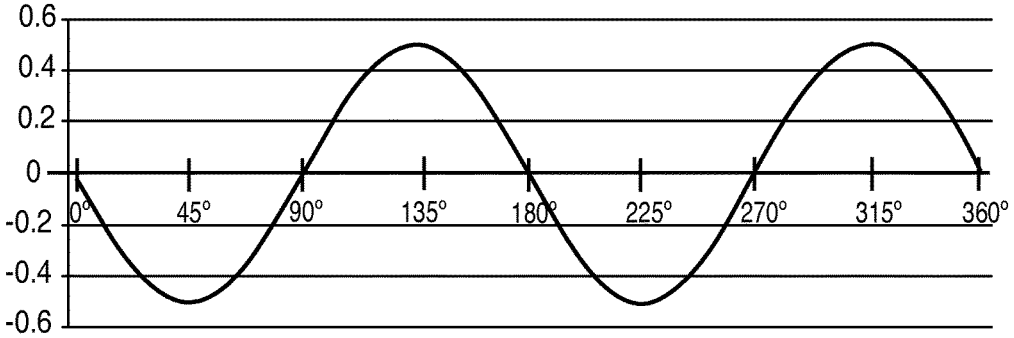
FIG. 5 is a sine wave which mathematically illustrates the contraction and expansion of the incremental variable distances between each impeller blade as it makes a full 360° rotation.

Turning to FIG. 5, this illustrates an example of the sine wave of the contraction and expansion of the incremental variable distances between each adjacent impeller blade as an impeller makes a full 360° rotation. The graph illustrates an example of the varying spacing in degrees from the adjacent blade along the entire 360° degree peripheral edge of the impeller. Each quadrant is responsible for its own peak or valley in the wave, and from the graph it can be seen that each quadrant has an equal amplitude in its respective motion (i.e., either expansion or contraction).

Figure 3:
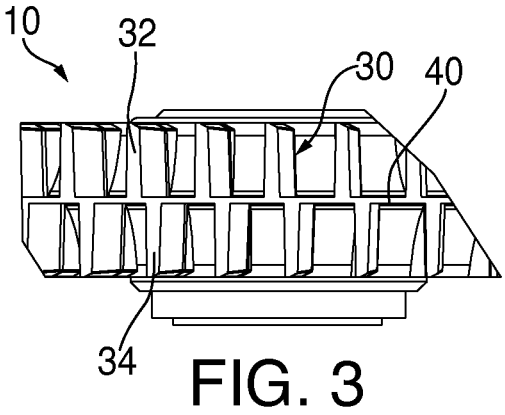
FIG. 3 is an enlarged view of area 3 in FIG. 2, showing the dividing rib and blade halves offset axially from each other.

In addition, as seen best FIGS. 2 and 3, each blade 30 includes a dividing rib 40 which is continuously located along the entire outer peripheral edge 24 of central hub 20. Dividing rib 40 extends radially outwardly from outer peripheral edge 24 of central hub 20 to the outer edges 34 of blades 30. Dividing rib 40 serves to provide a separation or reduction in the air turbulence within the housing chamber (not shown) generated by colliding vortices created on both sides of impeller 10. More particularly, divider 40 is located along the center of blades 30 dividing each of the blades 30 into a first blade half 32 and a second blade half 34. As seen best in FIG. 3, first blade half 32 is offset axially from second blade half 34, which serves to further break or reduce the continuity of the gas compression inside of the housing chamber, to even out noise since one peak occurs after another, thus flattening the sound wave's curve. Preferably, first blade half 32 is offset from second blade half 34 by ⅓ of the distance between the adjacent blades. However, it can be appreciated that the distance the blade halves are offset can vary depending on the application of the impeller, such as, for example ½ of the distance between the adjacent blade. Additionally, it is preferred that the divider 40 is the same material as the remainder of impeller 10. In the preferred embodiment, impeller 10 is a one-piece component die cast of aluminum.

Figure 6:
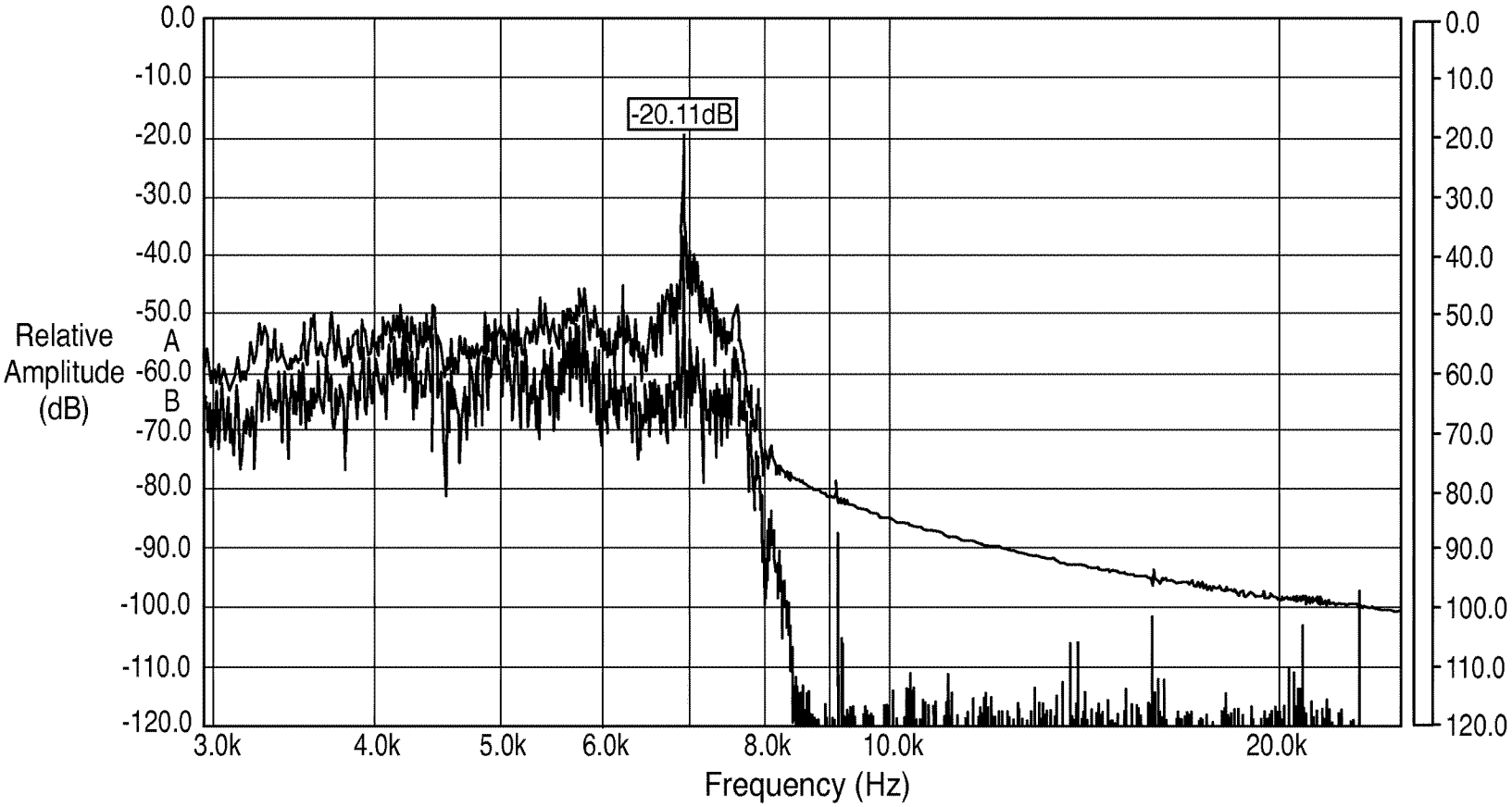
FIG. 6 PRIOR ART
FIG. 6 is a sound wave analysis of a prior art double-sided or "paddle wheel" impeller.

FIG. 6 graphically illustrates the sound wave analysis of a conventional prior art double-sided or "paddle wheel" impeller. The average of the cumulative measurements (line A) is graphed alongside the actual measurements (line B). From looking at line B, it is possible to see that the standard double-sided impeller produces an initial high-pitched noise that peaks near the center of the 6,000-8,000 Hertz range at a value of −20.11 decibels relative amplitude. Relative amplitude is expressed as a negative value with results closer to the origin of 0.0 (such as a value of −15) being louder than results further away, i.e. −100. As the frequency at which the impeller is rotated increases into ranges above 20,000 Hertz, the relative amplitude grows weaker which results in a fainter noise during operation. The impeller 10 of the present invention lowers the overall noise produced by the impeller, especially the peak in the 6,000-8,000 Hertz range.

Figure 7:
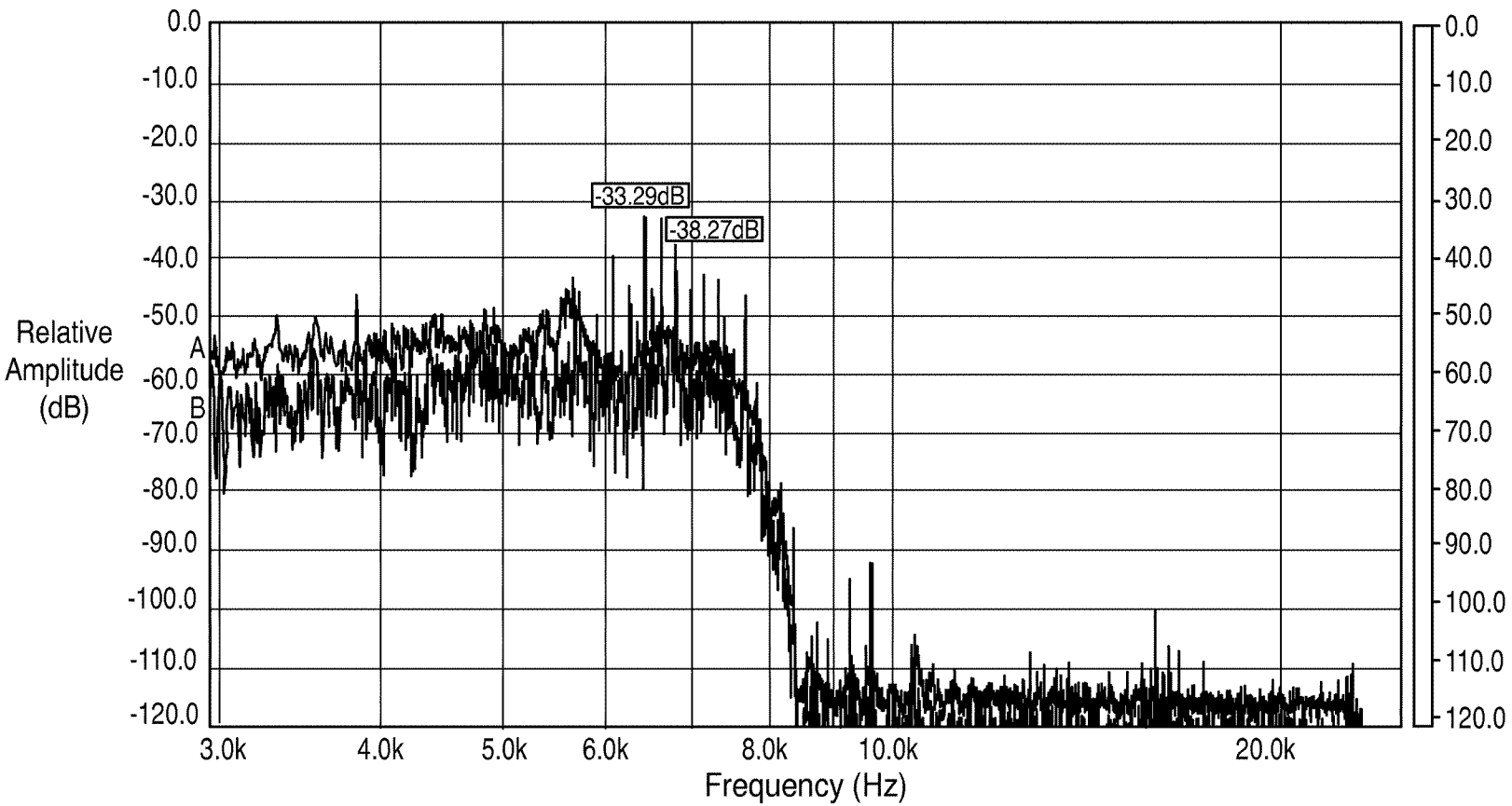
FIG. 7 is a sound wave analysis of the noise abating impeller of the present invention.

In comparison to FIG. 6, FIG. 7 graphically illustrates the sound wave analysis of an impeller of the present invention. The average of the cumulative measurements (line A) is graphed alongside the actual measurements (line B). From looking at line B, it is possible to see that the impeller 10 of the present invention generates a line with more "peaks" than the conventional prior art double-sided impeller, illustrated in FIG. 6. The invention also produces an initial high-pitched noise that peaks in the 6,000-8,000 Hertz range, but it is clear that there are many more of these peaks and they are at lower decibel levels. The highest two readings are −33.29 and -38.77 decibels of relative amplitude. From comparing FIG. 7 to FIG. 6, it can be seen that the impeller 10 of the present invention fragments the continuity of the gas compression within the housing chamber and reduces the overall peak of the sound wave, therefore diminishing overall noise.

While particular embodiments of the invention have been described, it is not intended that the invention be limited thereto, as it is intended that the invention be as broad in scope as the prior art will allow and that the specification be read likewise. It will therefore be appreciated by those skilled in the art that other modifications could be made thereto without departing from the spirit and scope of the invention.

Particularly, the number of blades 30 can vary depending on the specific application for the impeller. Furthermore, the angle of the spacing between adjacent blades can also vary depending on the specific application.

What is claimed is:

1. A noise abating impeller, comprising:

a disc-shaped central hub having a circular-shaped inner edge defining an opening therebetween which serves as an axis of rotation of said impeller, said central hub having a circular-shaped outer peripheral edge;

a plurality of blades extending radially outward from said outer peripheral edge of said central hub, wherein said blades have an inner edge connected to said outer peripheral edge of said central hub and an outer edge defining an outer edge of said impeller, and wherein said blades are symmetrically arranged in groupings around said central hub, wherein within alternating groupings, each blade progressing along said outer peripheral edge of said central hub in a counterclockwise direction is spaced an increasing distance apart from a prior adjacent blade by an incremental angle and wherein within the other alternating groupings, each blade progressing along said outer peripheral edge of said central hub in a counterclockwise direction is spaced a decreasing distance apart from a prior adjacent blade by said incremental angle and wherein said blades are arranged in said groupings such that adjacent blades have the same distance apart as the adjacent blades located symmetrically across said central hub; and a dividing rib located along the entire outer peripheral edge of said central hub which extends radially outwardly from said outer peripheral edge of said central hub to said outer edge of said impeller, and wherein said divider is located along the center of said blades dividing each of said blades into a first blade half and a second blade half, and wherein said first blade half is offset from said second blade half.

2. The impeller according to claim 1, wherein:
said impeller and said blades are the same material.

3. The impeller according to claim 2, wherein:
said impeller and said blades are made of aluminum.

4. The impeller according to claim 1, wherein:
the greatest distance between adjacent blades is about 5°.

5. The impeller according to claim 1, wherein:
the smallest distance between adjacent blades is about 4°.

6. The impeller according to claim 1, wherein:
said incremental angle is about 0.05°.

7. The impeller according to claim 1, wherein:
said impeller comprises approximately 70 to 90 blades.

8. The impeller according to claim 1, wherein:
each of said blades is bent at an angle of approximately 169°.

9. The impeller according to claim 1, wherein:
said blades are symmetrically arranged in quadrants around said central hub, wherein within two alternating quadrants, each blade processing along said outer peripheral edge of said central hub in a counterclockwise direction is spaced an increasing distance apart from a prior adjacent blade by said incremental angle and wherein within the other two alternating quadrants, each blade processing along said outer peripheral edge of said central hub in a counterclockwise direction is spaced a decreasing distance apart from a prior adjacent blade by said incremental angle.

10. The impeller according to claim 1, wherein:
said first blade half is offset from said second blade half by one-third of the distance between an adjacent blade.

* * * * *